US008538053B2

(12) United States Patent
Puder

(10) Patent No.: US 8,538,053 B2
(45) Date of Patent: Sep. 17, 2013

(54) HEARING DEVICE WITH FREQUENCY SHIFTING AND ASSOCIATED METHOD

(75) Inventor: Henning Puder, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 233 days.

(21) Appl. No.: 13/016,422

(22) Filed: Jan. 28, 2011

(65) Prior Publication Data

US 2011/0194714 A1 Aug. 11, 2011

Related U.S. Application Data

(60) Provisional application No. 61/299,370, filed on Jan. 29, 2010.

(30) Foreign Application Priority Data

Jan. 29, 2010 (DE) ..... 10 2010 006 154

(51) Int. Cl.
*H04R 25/00* (2006.01)

(52) U.S. Cl.
USPC ..... 381/318; 381/316

(58) Field of Classification Search
USPC ..... 381/317, 318, 23.1, 328, 330, 312; 600/25; 607/57, 59
See application file for complete search history.

(56) References Cited

U.S. PATENT DOCUMENTS

| | | | | |
|---|---|---|---|---|
| 5,121,009 | A * | 6/1992 | Braathen | 327/552 |
| 6,072,884 | A | 6/2000 | Kates | |
| 6,097,824 | A | 8/2000 | Lindemann et al. | |
| 6,104,822 | A | 8/2000 | Melanson et al. | |
| 6,434,246 | B1 | 8/2002 | Kates et al. | |
| 6,498,858 | B2 | 12/2002 | Kates | |
| 6,522,751 | B1 * | 2/2003 | Iwase et al. | 381/17 |
| 6,831,986 | B2 | 12/2004 | Kates | |
| 7,245,732 | B2 * | 7/2007 | Jorgensen et al. | 381/317 |
| 2004/0109578 | A1 | 6/2004 | Niederdrank et al. | |
| 2004/0252853 | A1 * | 12/2004 | Blamey et al. | 381/318 |
| 2005/0094827 | A1 | 5/2005 | McDermott et al. | |
| 2007/0269068 | A1 | 11/2007 | Komagel et al. | |
| 2011/0064253 | A1 * | 3/2011 | Gran et al. | 381/312 |
| 2011/0150256 | A1 | 6/2011 | Baechler et al. | |

FOREIGN PATENT DOCUMENTS

| | | | |
|---|---|---|---|
| DE | 102006020832 | A1 | 11/2007 |
| EP | 1033063 | B1 | 5/2003 |
| EP | 1401242 | A2 | 3/2004 |
| EP | 1480494 | A2 | 11/2004 |
| WO | 2009143898 | A1 | 12/2009 |

* cited by examiner

*Primary Examiner* — Curtis Kuntz
*Assistant Examiner* — David J Ho
(74) *Attorney, Agent, or Firm* — Laurence A. Greenberg; Werner H. Stemer; Ralph E. Locher

(57) ABSTRACT

A hearing device has a feedback suppression unit. The hearing device further has a low-pass filter characterized by a first cut-off frequency, which couples out a low-frequency signal component from an output signal of the hearing device, and a high-pass filter characterized by a second cut-off frequency, which couples out a high-frequency signal component from the output signal of the hearing device. A frequency shift unit shifts the frequency of the high-frequency signal component to higher frequencies. A gap exists between the first and the second cut-off frequency. As a result of the different limit frequencies, signal distortions caused by frequency shifts are effectively suppressed. Feedback is suppressed continuously and rapidly at higher frequencies.

10 Claims, 4 Drawing Sheets

HEARING DEVICE WITH FREQUENCY SHIFTING AND ASSOCIATED METHOD

CROSS-REFERENCE TO RELATED APPLICATION

This is a continuation application, under 35 U.S.C. §120, of copending U.S. provisional application No. 61/299,370, filed Jan. 29, 2010, this application also claims the priority, under 35 U.S.C. §119, of German patent application No. DE 10 2010 006 154.9, filed Jan. 29, 2010; the prior applications are herewith incorporated by reference in their entireties.

BACKGROUND OF THE INVENTION

Field of the Invention

The invention relates to a method for operating a hearing device and to a hearing device with improved feedback suppression through the use of an optimized frequency filter.

A frequent problem with hearing devices is the feedback between the output of the hearing device and the input, which makes itself evident as an annoying whistling. FIG. 1 shows the principle of acoustic feedback. A hearing device 1 has a microphone 2 which receives an acoustic useful signal 10, converts it into an electrical microphone signal 11 and outputs it to a signal processing unit 3. In the signal processing unit 3 the microphone signal 11 undergoes processing such as preparation, amplification and output to an earpiece 4 as an electrical earpiece signal 12. In the earpiece 4 the electrical earpiece signal 12 is converted back into an acoustic output signal 13, and output to an eardrum 7 of a hearing aid wearer.

The problem now is that part of the acoustic output signal 13 reaches the input of the hearing device 1 via an acoustic feedback path 14 where it superimposes itself on the useful signal 10 and is picked up by the microphone 2 as a sum signal. With an unfavorable phase position and amplitude of the fed back output signal the result is annoying feedback whistling. With an open hearing aid supply in particular the attenuation of the acoustic feedback is low, which exacerbates the problem.

Adaptive systems for feedback suppression have been available for some time as a solution. These involve simulating the acoustic feedback path 14 in the hearing device 1 digitally. The simulation is undertaken for example by an adaptive compensation filter 5 which is fed by the earpiece signal 12. After filtering in the compensation filter 5, a filtered compensation signal 15 is subtracted from the microphone signal 11. In the ideal case the effect of the acoustic feedback path 14 is canceled out by this and a feedback-free input signal 16 is produced for the signal processing unit 3.

For effective feedback suppression a regulation or adaptation of filter coefficients of the adaptive compensation filter 5 is required. To this end the microphone signal 11 is evaluated with the aid of a detection unit 6 and investigated for possible feedback. Artifacts can also be produced however by the regulation or adaptation of the filter coefficients, since with an adaptive compensation filter 5 which is not set optimally, additional signal components will be created or feedback whistling will occur. European patent EP 1 033 063 B1, corresponding to U.S. Pat. Nos. 6,104,822, 6,434,246, 6,831,986, 6,097,824, 6,072,884 and 6,498,858, discloses a hearing device with feedback suppression wherein, for improving the feedback suppression, two adaptive compensation filters operating in parallel are employed.

A high correlation between the useful signal 10 and the feedback signal 14 represents a major problem for an optimum feedback suppression, because input signal components will also be addressed by the correlation and incorrect adaptations of the compensation filter can occur.

A solution to this problem is disclosed in JASA Vol. 94, pt. 6, 1993-December, 3248 ff. A useful signal is decorrelated from a fed back noise signal by the frequency of the output signal of a hearing device and thereby the frequency of the fed back signal being shifted in relation to the frequency of the useful signal.

Unfortunately the frequency shifts or distortions also cause clearly perceptible artifacts. A distortion at low frequencies is not possible as a rule since in the low frequency range the human hearing reacts very sensitively to distortions. Therefore mostly only the high frequencies are shifted. Despite this the result can be an audible "detuning" of the useful signal.

Considerably more unpleasant are overlay artifacts in which a signal shifted in frequency and a non-shifted signal are perceived at the same time which leads with tonal signals to a marked modulation or fluctuation or to a roughness. Acoustic overlays are almost inevitable which arise through the inflow of direct sound, through the vent for example.

As a result of construction overlays can however also arise from non-ideal split-band filters. To enable only high-frequency frequency components to be shifted, these must be separated from the low-frequency components. This requires a frequency filter, also called a split-band filter. The filter cannot however carry out ideal separation, which means that disruptive overlays result in the area of the cut-off frequency of the filter.

Depending on the frequency shift, these overlays will be perceived as amplitude modulation or as signal roughness. In all cases described the overlays are disruptive, especially when an input signal involves music or more generally tonal signals.

Known filters in hearing devices are of the Butterworth type. They are not ideal and have a finite frequency overlap at their cut-off frequency GF. FIG. 2 shows an example of the frequency curve of a 9th-order type Butterworth frequency filter of a hearing device with a cut-off frequency GF of 900 Hz. The curves K1, K2 show the amplitude D in dB as a function of the frequency F in Hz in the range 0 to 1150 Hz. The curve K1 shows a low-pass characteristic and the curve K2 a high-pass characteristic. The sum curve K3 of the curves K1 and K2 produces a flat, constant frequency response. The curve K4 compared to the curve K2 shows a high-path characteristic shifted by 25 Hz to higher frequencies.

With an addition of the signal components according to the curves K1 and K3 the result is, above all in the area of the cut-off frequency G2, overlays which cannot be ignored of signal components shifted in frequency and not shifted, which in an output signal of the hearing device is perceived as modulation or heavy roughness. Both effects are disruptive and are perceived by the hearing device wearer mostly markedly more strongly than frequency shifting.

SUMMARY OF THE INVENTION

It is accordingly an object of the invention to provide a hearing device with frequency shifting and an associated method which overcomes the above-mentioned disadvantages of the prior art devices of this general type, which reduces the perception of artifacts of a frequency shifting in hearing devices.

A hearing device has an adaptive feedback suppression unit and a signal processing unit. The hearing device also contains a low-pass filter characterized by a first cut-off frequency that couples a load frequency signal component out of an output signal of the signal processing unit, a high-pass filter characterized by a second cut-off frequency that couples a high-frequency signal component out of the output signal of the signal processing unit, and a frequency shifting unit which shifts the frequency of the high-frequency signal component to higher frequencies. Between the first and the second cut-off frequency there exists a predeterminable distance or a gap. Signal distortions caused by a frequency shift are effectively suppressed by the different limit frequencies. The reason is that fewer overlapping shifted and unshifted signal components arise in this way. This enables a feedback suppression to operate continuously at higher frequencies. The suppression is then undertaken quickly.

In a development the distance can be between 20 Hz and 50 Hz in size. Trials have shown that a distance between the limit frequencies of this size is sufficient.

In a further form of embodiment of the invention the frequency shift of the high-frequency signal component can amount to 10 Hz to 30 Hz. Acoustic feedback suppression is optimized by this.

Furthermore the hearing device contains an adder in which the low-frequency signal component and the high-frequency signal component shifted in frequency are summed, with an output signal of the hearing device being formed.

Preferably the low-pass filter and/or the high-pass filter can be embodied as Cauer filters (also referred to as elliptical filters). The great edge steepness of this filtered type more effectively prevents signal distortions.

The invention also relates to a method for frequency shifting in a hearing device. The method includes the steps of:

coupling out a low-frequency signal component from a signal-processed microphone signal (at the output of a signal processing unit) by a low-pass filter characterized by a first cut-off frequency;

coupling out a high-frequency signal component from a signal-processed microphone signal (at the output of a signal processing unit) by a high-pass filter characterized by a second cut-off frequency, with a predeterminable distance or a gap being present between the first and the second cut-off frequency; and shifting the frequency of the high-frequency signal component to higher frequencies.

In a development of the method the distance between the limit frequencies can be selected between 20 Hz and 50 Hz.

In a further form of embodiment of the method the frequency of the high-frequency signal component can be shifted by 10 Hz to 30 Hz.

The method preferably also contains an addition of the low-frequency signal component and the high-frequency signal component shifted in the frequency, with an output signal of the hearing device being formed.

In addition the low-pass filter and/or the high-pass filter can be configured as a Cauer filter.

Other features which are considered as characteristic for the invention are set forth in the appended claims.

Although the invention is illustrated and described herein as embodied in a hearing device with frequency shifting and an associated method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
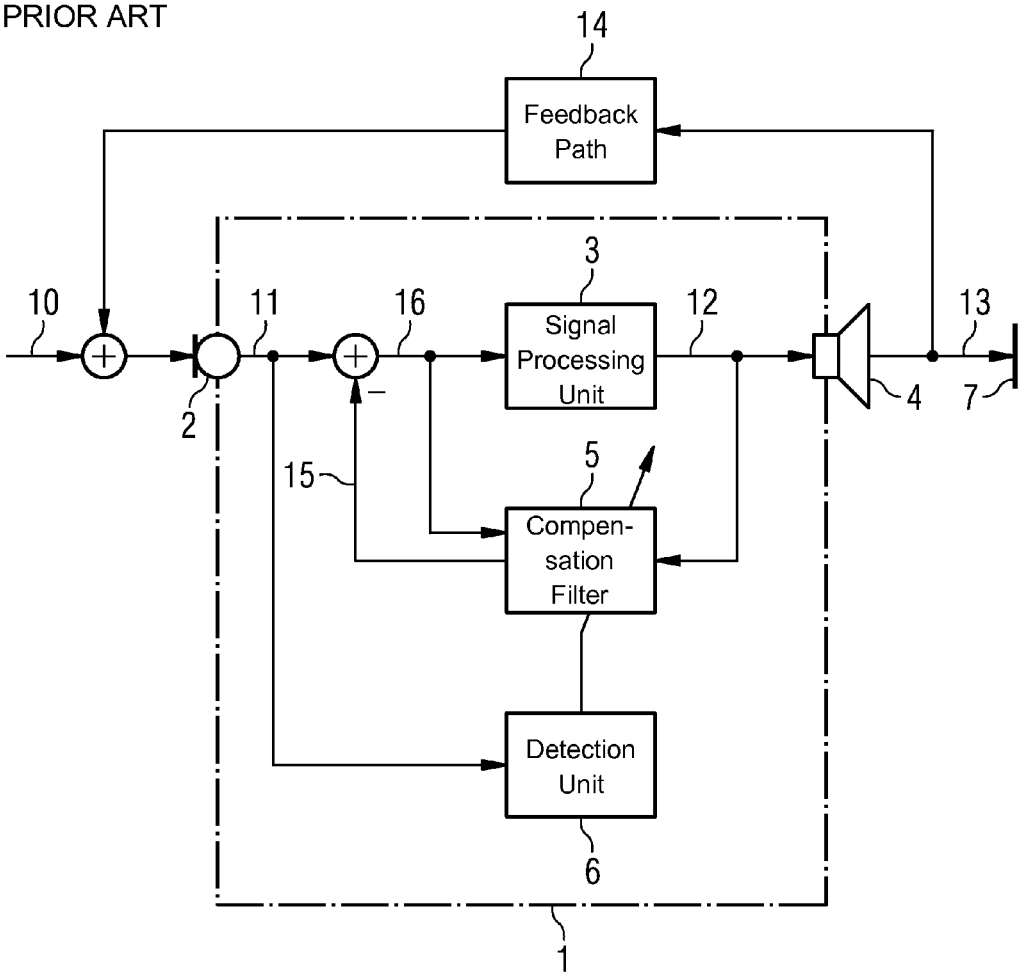
FIG. 1 PRIOR ART
FIG. 1 is a block diagram of a hearing device with acoustic feedback and feedback suppression according to the prior art.
Figure 2:
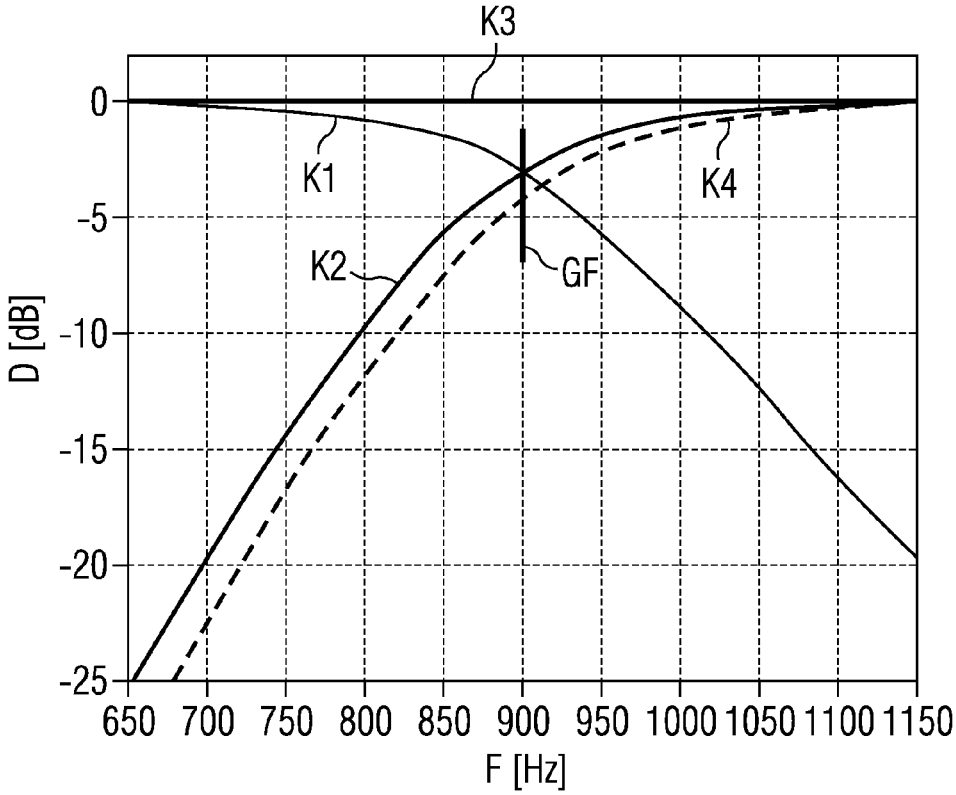
FIG. 2 PRIOR ART
FIG. 2 is a graph showing a frequency curve of a 9th-order Butterworth frequency filter according to the prior art.
Figure 3:
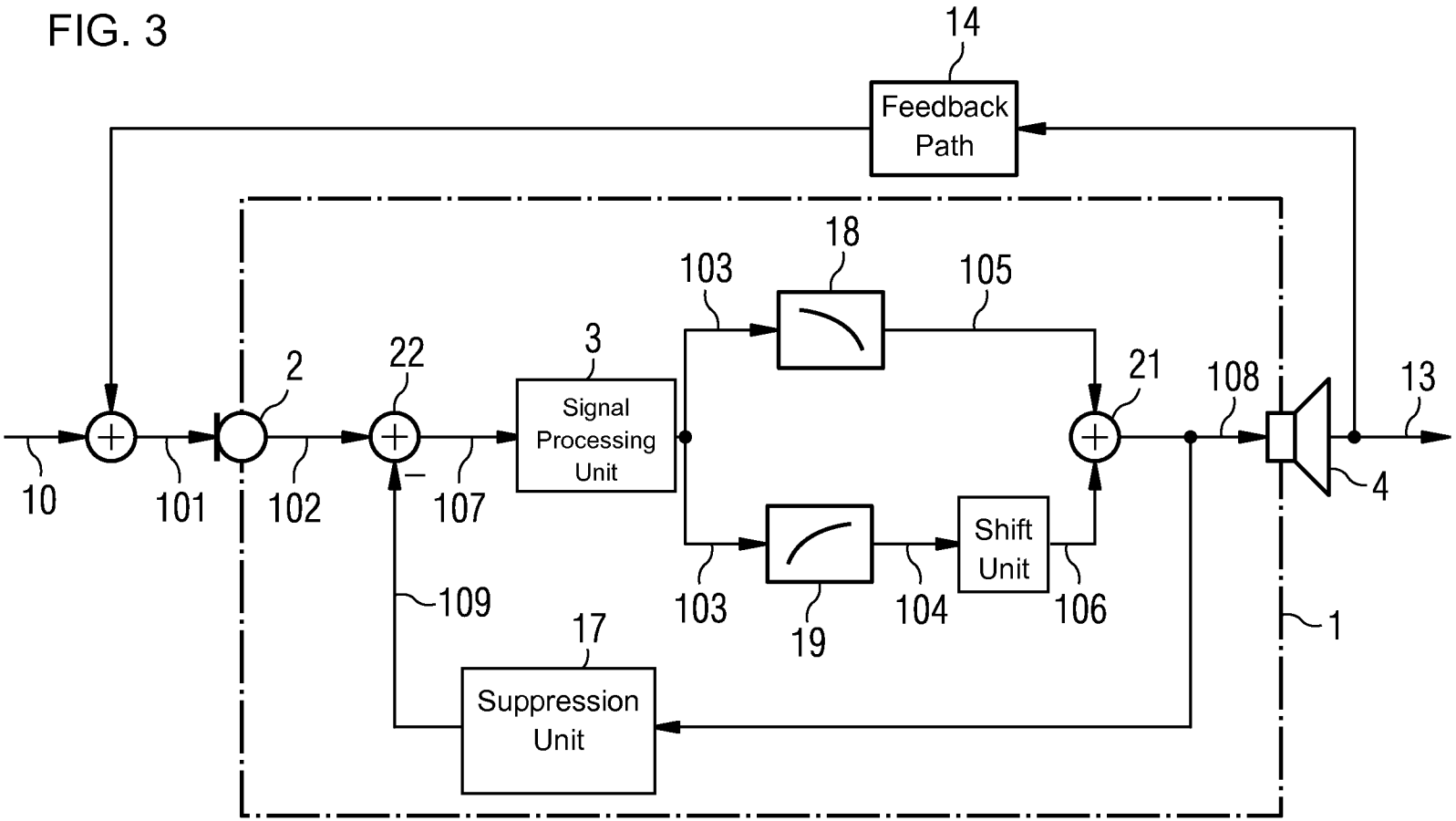
FIG. 3 is a block diagram of a hearing device with feedback suppression and a frequency filter according to the invention.

Referring now to the figures of the drawing in detail and first, particularly, to FIG. 3 thereof, there is shown a hearing device 1 with a microphone 2 picking up an acoustic input signal 101 and with an earpiece 4 outputting an acoustic output signal 13. As described above, a part of the output signal 13 is fed back via a feedback path 14 to the microphone 2 of the hearing device 1, wherein it is overlaid with a useful signal 10 to form an input signal 101. The microphone 2 converts the acoustic input signal 101 into an electrical microphone signal 102.

Any acoustic feedback that might arise is detected with the aid of a feedback suppression unit 17, simulated from an earpiece input signal 108 and added as an inverted feedback suppression signal 109 to the microphone signal 102 in a second adder 22. At the output of the second adder 22 a feedback-suppressed microphone signal 107 is thus produced which is fed to a signal processing unit 3. An output signal 103 of the signal processing unit 3 is fed to the input of a frequency filter with a low-pass filter 18 and a high-pass filter 19.

A low-pass output signal 105 is available at the output of the low-pass filter 18 and a high-pass output signal 104 is available at the output of the high-pass filter 19. The high-pass output signal 104 is shifted with the aid of a frequency shift unit 25 by around 10 Hz to 30 Hz towards higher frequencies. The frequency-shifted high-pass output signal 106 is added in a first adder 21 to the low-pass output signal 105.

An earpiece input signal 108 is available at the output of the first adder 21, which is converted by the earpiece 4 into the acoustic output signal 13.

In accordance with the invention the low-pass filter 18 and the high-pass filter 19 have different limit frequencies GF1, GF2, whereby practically no disruptive overlay effects can arise from original signal components and frequency-shifted signal components. Preferably the two filters 18, 19 are elliptical filters, also referred to as Cauer filters. They possess an especially steep edge, which can bring about an extreme reduction of an undesired signal overlay in the filter overlap area in addition to the different choice of the limit frequencies.

The invention is able to be used both for hearing devices with one microphone and for devices with a number of microphones. With a number of microphones there are also a number of feedback suppression units and a number of inventive frequency filters which are supplied by different signal-processed microphone signals.

Figure 4:
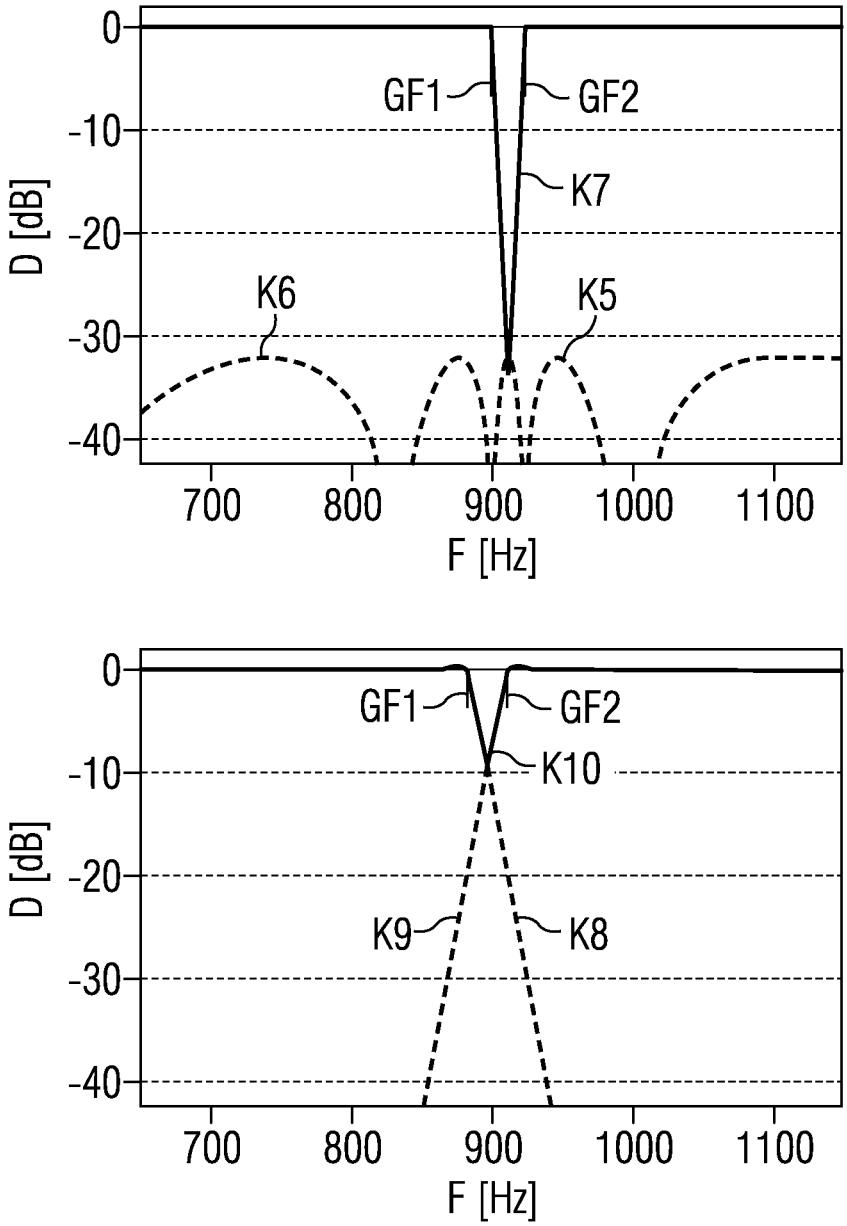
FIG. 4 is a graph showing frequency curves of two Cauer filters.

Frequency curves K5, K6, K7, K8, K9, K10 of corresponding Cauer filters employed in accordance with the invention are shown in FIG. 4. The two diagrams of FIG. 4 show the amplitude D in dB as a function of the frequency F in kHz for a frequency range of 650 Hz to 1150 Hz.

The upper diagram of FIG. 4 shows the frequency curves K5, K6 of first Cauer filters with a narrow and deep notch of the sum frequency curve K7 as a result of a corresponding embodiment of the first Cauer filters. The distance between the first cut-off frequency GF1 of the low-pass (curve K5) and the second cut-off frequency GF2 of the high-pass (curve K6) is selected relatively small. The first cut-off frequency GF1 lies at around 890 Hz, the second cut-off frequency GF2 at around 910 Hz.

The lower diagram of FIG. 4 shows the frequency curves K8, K9 of second Cauer filters with a broader and less deep notch of the sum frequency curve as a result of a corresponding embodiment of the second Cauer filters. A wider gap is selected between the first cut-off frequency GF1 of the low-pass (curve K8) and the second cut-off frequency GF2 of the high-pass (curve K9). The first cut-off frequency GF1 lies at around 880 Hz and the second cut-off frequency GF2 at around 920 Hz.

Trials have shown that the invention generates significantly lower signal disturbances in the hearing devices with frequency shifting, because no duplicated frequency components occur, which would cause a rough sound.

The invention claimed is:

1. A hearing device, comprising:

a feedback suppression unit;

a signal processing unit coupled to said feedback suppression unit, said signal processing unit having an output providing an output signal;

a low-pass filter coupled to said signal processing unit and characterized by a first cut-off frequency, couples a low-frequency signal component out of said output signal of said signal processing unit;

a high-pass filter having an input coupled to said output of said signal processing unit and characterized by a second cut-off frequency, couples a high-frequency signal component out of the output signal of said signal processing unit, with there being a predetermined distance between the first and the second cut-off frequencies; and a frequency shift unit, which shifts a frequency of the high-frequency signal component to higher frequencies.

2. The hearing device according to claim 1, wherein the distance is between 20 Hz and 50 Hz in size.

3. The hearing device according to claim 1, wherein a frequency shift of the high-frequency signal component amounts to 10 Hz to 30 Hz.

4. The hearing device according to claim 1, further comprising a first adder, in which the low-frequency signal component and the high-frequency signal component shifted in frequency are summed, from which an output signal of the hearing device is able to be formed.

5. The hearing device according to claim 1, wherein at least one of said low-pass filter or said high-pass filter is embodied as Cauer filters.

6. A method for frequency shifting in a hearing device, which comprises the steps of:

coupling out a low-frequency signal component from a signal-processed microphone signal via a low-pass filter characterized by a first cut-off frequency;

coupling out a high-frequency signal component from the signal-processed microphone signal via a high-pass filter characterized by a second cut-off frequency, with a predetermined distance existing between the first and the second cut-off frequency; and shifting a frequency of the high-frequency signal component to higher frequencies.

7. The method according to claim 6, which further comprises selecting the distance to be between 20 Hz and 50 Hz.

8. The method according to claim 6, which further comprises shifting the frequency of the high-frequency signal component by 10 Hz to 30 Hz.

9. The method according to claim 6, which further comprises forming an addition of the low-frequency signal component and the frequency shifted high-frequency signal component, with an output signal of the hearing device.

10. The method according to claim 6, which further comprises embodying at least one of the low-pass filter or the high-pass filter as Cauer filters.

* * * * *